US010208997B2

(12) United States Patent
Visin

(10) Patent No.: US 10,208,997 B2
(45) **Date of Patent: *Feb. 19, 2019**

(54) ICE CRUSHING SYSTEM

(71) Applicant: Whirlpool Corporation, Benton Harbor, MI (US)

(72) Inventor: Jerold M. Visin, Benon Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 91 days.

This patent is subject to a terminal disclaimer.

(21) Appl. No.: 15/182,831

(22) Filed: Jun. 15, 2016

(65) Prior Publication Data

US 2016/0290700 A1 Oct. 6, 2016

Related U.S. Application Data

(63) Continuation of application No. 13/767,121, filed on Feb. 14, 2013, now Pat. No. 9,372,023.

(51) Int. Cl.

| | |
|---|---|
| ***F25C 5/02*** | (2006.01) |
| ***F25C 5/04*** | (2006.01) |
| ***F25D 11/02*** | (2006.01) |
| ***F25C 5/20*** | (2018.01) |

(52) U.S. Cl.
CPC ..... *F25C 5/046* (2013.01); *F25C 5/22* (2018.01); *F25D 11/02* (2013.01)

(58) Field of Classification Search
CPC ..... F25C 1/147; F25C 5/046; F25C 5/182; F25C 5/02; F25C 5/04
USPC ..... 62/71, 320, 340, 344
See application file for complete search history.

(56) References Cited

U.S. PATENT DOCUMENTS

| | | | | |
|---|---|---|---|---|
| 2,235,217 | A | 3/1941 | Koch | |
| 3,843,067 | A | 10/1974 | Prada | |
| 4,176,527 | A | 12/1979 | Hartman et al. | |
| 4,972,999 | A * | 11/1990 | Grace | F25C 5/046 241/101.1 |
| 5,056,688 | A * | 10/1991 | Goetz | F25C 5/005 222/146.6 |
| 5,125,242 | A | 6/1992 | Von Blanquet | |
| 5,273,219 | A | 12/1993 | Beach et al. | |
| 6,109,476 | A | 8/2000 | Thompson et al. | |
| 7,111,473 | B2 | 9/2006 | Chung et al. | |
| 7,278,275 | B2 * | 10/2007 | Voglewede | F25C 5/005 241/DIG. 17 |
| 7,748,230 | B2 | 7/2010 | An | |
| 7,836,719 | B2 | 11/2010 | Jeong et al. | |
| 9,372,023 | B2 * | 6/2016 | Visin | F25C 5/046 |
| 2006/0144976 | A1 * | 7/2006 | Lee | B02C 18/14 241/63 |

(Continued)

*Primary Examiner* — Melvin Jones
(74) *Attorney, Agent, or Firm* — Diederiks & Whitelaw, PLC

(57) ABSTRACT

An ice crushing system includes multiple sets of interleaved blades with some of the blades being provided with a series of raised protrusions on one or more faces. With this arrangement, the spacing between the interleaved blades is reduced and a finer crushed ice consistency is established. In accordance with aspects of the invention, the raised protrusions are staggered along each side of a set of fixed blades, with the raised protrusions on one side of a fixed blade overlapping the raised protrusions on the opposing side.

20 Claims, 3 Drawing Sheets

(56) References Cited

U.S. PATENT DOCUMENTS

| | | | | |
|---|---|---|---|---|
| 2006/0248911 | A1 | 11/2006 | An et al. | |
| 2006/0248912 | A1* | 11/2006 | Park | F25C 5/005 62/344 |
| 2008/0156826 | A1 | 7/2008 | Kim et al. | |
| 2009/0255289 | A1 | 10/2009 | Friedmann et al. | |
| 2010/0199846 | A1 | 8/2010 | Aus Der Fuenten | |
| 2010/0218538 | A1 | 9/2010 | Buchstab et al. | |
| 2011/0048052 | A1 | 3/2011 | Lee et al. | |
| 2011/0120152 | A1 | 5/2011 | Talegaonkar et al. | |
| 2011/0138837 | A1 | 6/2011 | Chase et al. | |

* cited by examiner

ICE CRUSHING SYSTEM

CROSS-REFERENCE TO RELATED APPLICATIONS

This application is a continuation of U.S. patent application Ser. No. 13/767,121 filed on Feb. 14, 2013. The entire content of this application is incorporated by reference.

BACKGROUND OF THE INVENTION

1. Field of the Invention

The present invention pertains to the art of refrigeration and, more particularly, to an ice crushing system for use in a refrigeration unit.

2. Description of the Related Art

In the art of refrigerators, particularly household refrigerators, it is common to provide an automatic icemaker within a freezer compartment or even a below freezing chamber provided in a fresh food compartment in order to produce ice cubes. It is also common to provide a system for dispensing the ice, such as through a dispenser exposed at the front face of the refrigerator. Generally, these systems provide for the automatic filling of one or more ice cube trays which are periodically emptied into a bin following a freezing period. From the bin, the ice can be delivered to the dispenser by the selective activation of a drive unit, such as a rotatable auger located within the bin. Most often, such ice dispensing systems incorporate a mechanism whereby the ice can be selectively crushed prior to reaching the dispenser.

In the industry, there has heretofore been proposed various different systems to accomplish this ice dispensing function. At least in one respect, these systems differ in the particular manner in which the ice can be crushed, with numerous types of ice crushing mechanisms having been proposed in the art. For example, it is known to provide multiple sets of crushing blades which rotate about a common axis with an auger wherein one of the blades sets is fixed for rotation with the auger and the other blade is freely rotatable about the common axis. When crushed ice is selected, the freely rotatable blade set is secured against rotation such that the cubes of ice are crushed between the two sets of blades. In another known system, an anvil member can be positioned in an ice delivery passage and cubes of ice can be crushed between the anvil member and a single set of blades which rotate with the ice delivery auger. Finally, it is also known to linearly shift a first set of ice crushing blades into an ice delivery path so that cubes of ice can be crushed between the first set of blades and a second set of blades which rotates with the delivery auger.

With each of these known systems, the blades are substantially planar and arranged parallel to each other. The distance between the blades establishes the degree to which the ice can be crushed. That is, a greater distance between the blades results in more coarse crushed ice pieces, while minimizing the distance establishes finer ice pieces. Unfortunately, certain minimum gap requirements are mandated in connection with the mounting of the blades given the associated tolerances and the need to avoid the blades becoming entangled and the overall mechanism breaking. With this in mind, it would be beneficial to provide a unique manner to enhance crushed ice consistency without major changes to an existing ice crushing system.

SUMMARY OF THE INVENTION

The present invention is directed to an ice crushing system for a refrigeration unit, such as an ice crushing system employed in connection with selectively dispensing cubed or crushed ice through a dispenser in a household refrigerator. More particularly, the invention is directed to changing the consistency of the crushed ice from coarse to fine. The invention finds specific application to an ice crushing system having multiple sets of interleaved blades. The consistency function is specifically achieved in accordance with the invention by providing a series of raised projections or protrusions on one or more faces of select ones of the blades. With this arrangement, the spacing between the interleaved blades is reduced and a finer consistency of crushed ice can be established.

In one form of the invention, the ice crushing system includes both fixed and rotating blade sets. When crushed ice is desired, the rotating blades are interposed between the fixed blades. Without altering the basic drive arrangement for the ice crushing system, the invention provides the raised protrusions on one of the sets of blades. For instance, in one embodiment, raised circular protrusions are provided at spaced positions on faces of the fixed crusher blades to establish tighter spacings or gaps between the fixed and rotating blades to allow the finer consistency of the crushed ice.

Additional objects, features and advantages of the invention will become readily apparent from the following detailed description of preferred embodiments of the invention when taken in conjunction with the drawings wherein like reference numerals refer to corresponding parts in the several views.

DETAILED DESCRIPTION OF PREFERRED EMBODIMENTS

Figure 1:
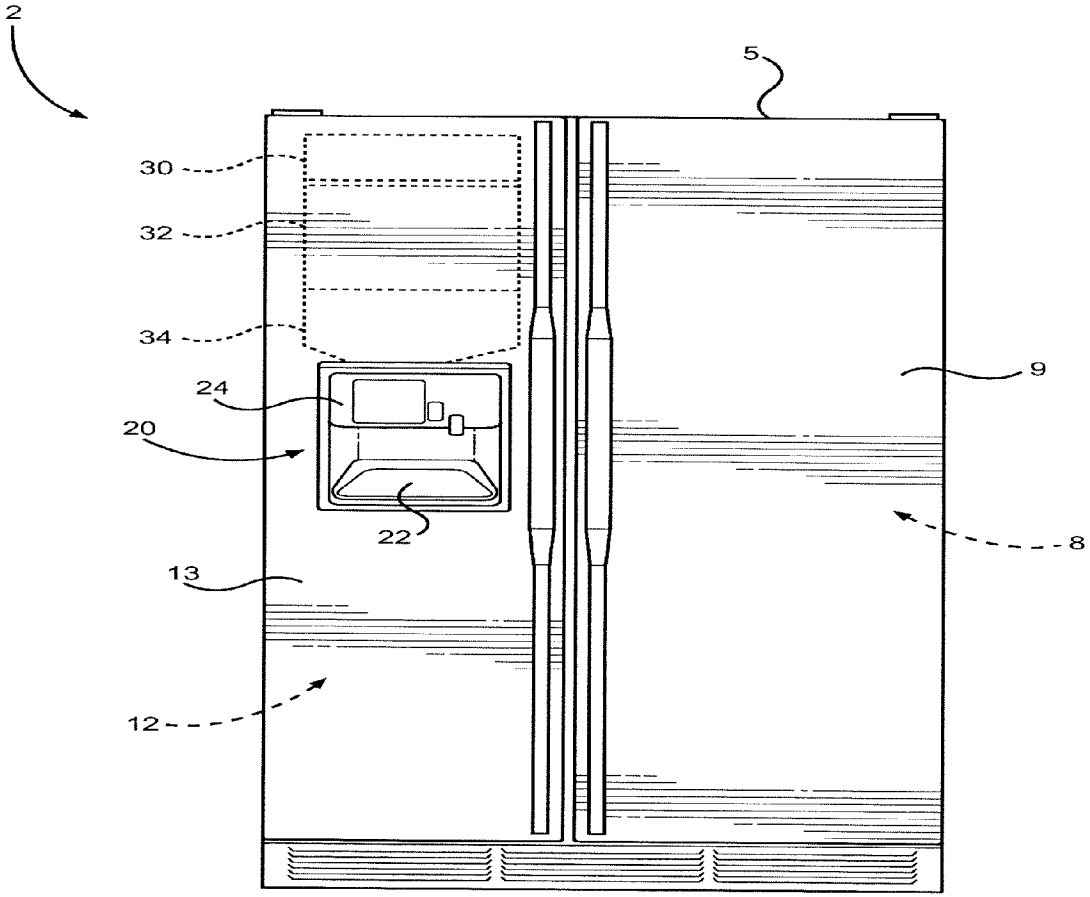
FIG. 1 is a front elevational view of a side-by-side refrigerator incorporating the ice crushing system of the present invention.

With initial reference to FIG. 1, a refrigerator 2 includes a cabinet 5 within which is defined a fresh food compartment 8. In a manner known in the art, fresh food compartment 8 can be accessed by the selective opening of a fresh food door 9. In a similar manner, a freezer compartment 12 can be accessed upon opening a door 13. At this point, it should be recognized that refrigerator 2 constitutes a side-by-side refrigerator. However, as will become more fully evident below, the invention can be applied to various types of known household refrigerator styles, including top mount, bottom mount and French door style refrigerators. Actually, the invention can be employed with any type of refrigeration unit designed to produce crushed ice.

In the exemplary embodiment depicted, freezer compartment door 13 is provided with a dispenser 20, such as for the select dispensing of water and ice. To this end, dispenser 20 includes a recessed dispensing well 22 adapted to receive a container for the receipt of the water and/or ice, as well as a panel 24 for establishing a desired dispensing operation. In connection with the dispensing of ice, refrigerator 2 is provided with an icemaker 30 which functions to automatically produce ice and deliver the same into a lower positioned ice bin 32. From ice bin 32, the ice can be delivered to dispensing well 22 through an ice crushing region 34 which, in accordance with the invention, is constructed to provide for fine consistency of the crushed ice.

Figure 2:
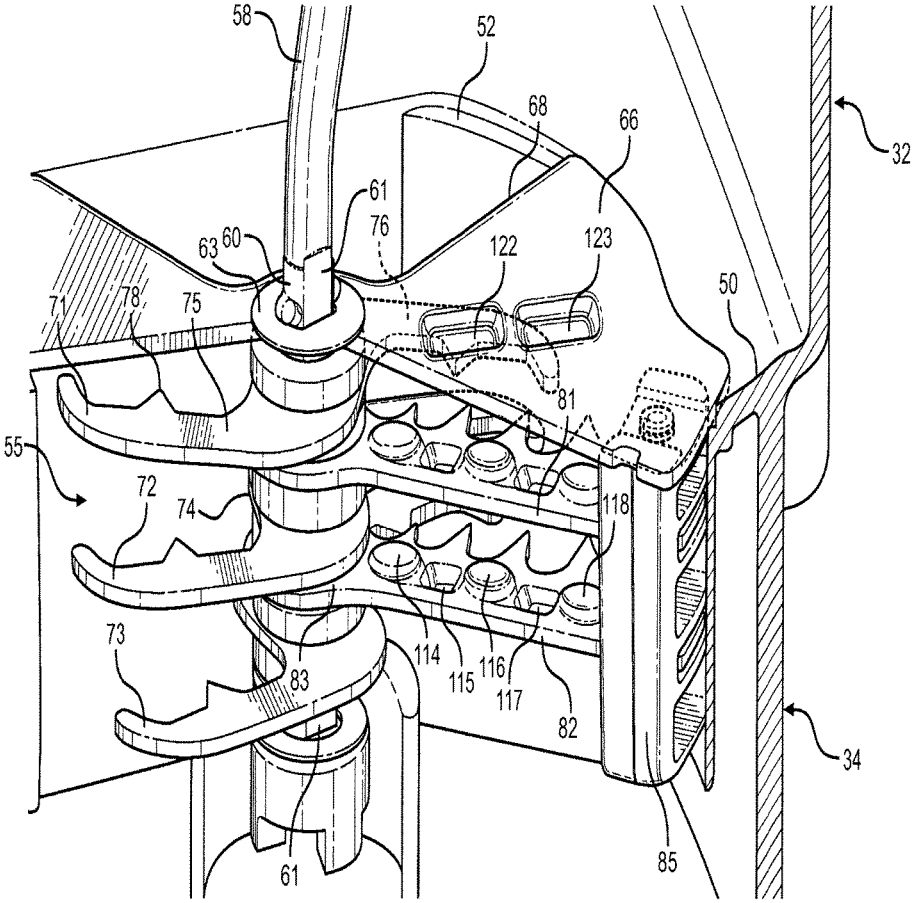
FIG. 2 is a partial cross-sectional view of a portion of the ice crushing system of FIG. 1.

More specifically, as shown in detail in FIG. 2, ice crushing region 34 is defined in part by an in-turned portion 50 which establishes a ledge 52 and has mounted therein an ice crushing system 55 constructed in accordance with the invention. Extending into ice crushing region 34 from ice bin 32 is an auger 58. As illustrated, auger 58 has a terminal end portion 60 provided with at least one fattened face 61. Arranged along terminal end 60 is shown to be a washer 63, followed by a divider plate 66. Divider plate 66 is positioned along ledge 52 of in-turned portion 50 and includes an ice receiving opening 68 through which cubes of ice from ice bin 32 are directed prior to reaching dispenser 20. Below divider plate 66 and mounted to auger 58 for co-rotation are a first set of rotatable blades 71-73. Each rotatable blade 71-73 includes a central body portion 74 from which projects first and second arms 75 and 76. In a manner known in the art, central body portion 74 includes a central opening (not shown) which includes a flat portion conforming to flattened face 61 of auger 58 such that rotation of auger 58 also results in rotation of blades 71-73. As also clearly shown in this figure, arms 75 and 76 of each blade 71-73 is formed with one or more sharpened sections which define teeth such as indicated at 78.

Interleaved with rotatable blades 71-73 are a second set of fixed blades 81 and 82. More specifically, fixed blade 81 is interposed between rotatable blades 71 and 72, while fixed blade 82 is interposed between rotatable blades 72 and 73. Unlike central body portion 74, a central body portion 83 of each fixed blade 81, 82 is freely supported about terminal end portion 60 such that auger 58 rotates relative to blades 81 and 82, essentially in a manner corresponding to divider plate 66. At an end remote from terminal end portion 60 of auger 58, each fixed blade 81, 82 is also secured to a support mount 85 attached to divider plate 66.

Figure 3:
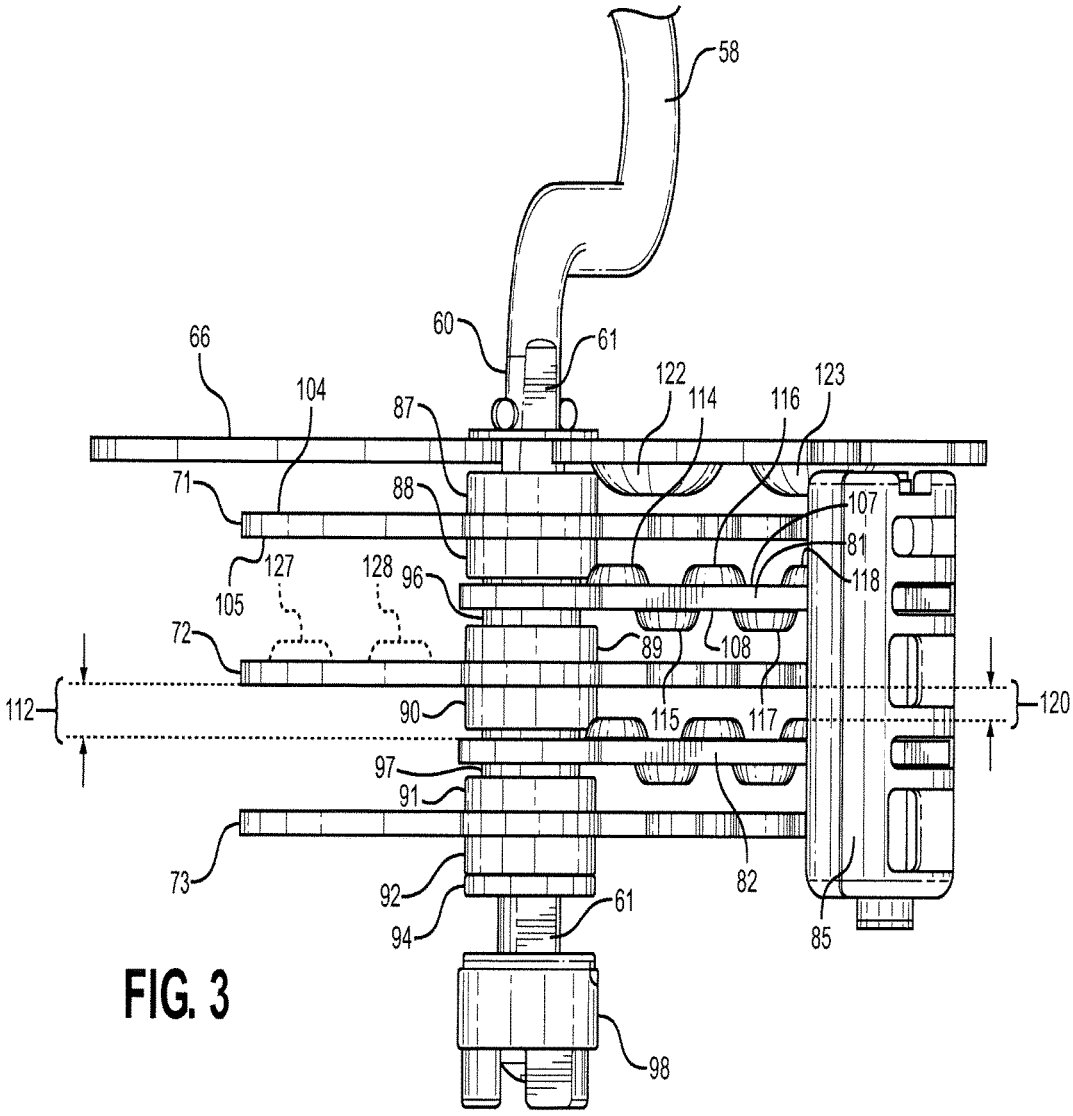
FIG. 3 is a top view mainly of interleaved blades of the ice crushing system of FIG. 2.

As shown in FIGS. 2 and 3, a plurality of axial arranged spacers 87-92 are provided between divider plate 66 and rotatable blade 71, rotatable blade 71 and fixed blade 81, fixed blade 81 and rotatable blade 72, rotatable blade 72 and fixed blade 82, fixed blade 82 and rotatable blade 73, and rotatable blade 73 and a washer 94 respectively. Actually, between spacers 88 and 89, as well as spacers 90 and 91, are provided reduced diametric spacer portions 96 and 97 at which fixed blades 81 and 82 are respectively mounted. In addition, fixed to terminal end portion 60 of auger 58 is a drive mount 98 which a motor (not shown) is adapted to engage for rotating auger 58.

At this point, it should be recognized that the above construction is known in the art and merely presented for the sake of completeness. That is, it is known to select crushed ice for dispensing into well 22 wherein cubes of ice are directed through ice receiving opening and, prior to exiting ice crushing region 34, are forced to be crushed between the interleaved sets of blades 71-73 and 81-82. In such prior known arrangements, each rotatable blade 71-73 is substantially planar, with opposing faces 104 and 105. In a similar manner, the fixed blades in prior known arrangements would include planar faces 107 and 108 which would establish a gap 112 which, in turn, establishes the degree of crushing of the ice. That is, the larger gap 112, the coarser the crushed ice. While maintaining a corresponding blade mounting arrangement, the invention provides a series of raised protrusions 114-118 on at least some of the interleaved blades in order to establish a much smaller gap 120.

In the embodiment shown, raised protrusions 114-118 are provided on each of fixed blades 81 and 82. More specifically, protrusions 114, 116 and 118 project from face 107 and protrusions 115 and 117 project from face 108 for each fixed blade 81, 82. As shown, the protrusions 114, 116 and 118 are spaced along face 107, while protrusions 115 and 117 are spaced along face 108. Therefore, the raised protrusions 114-118 are staggered along each side or face 107, 108 of the fixed blades 81 and 82, with the raised protrusions 114, 116 and 118 on face 107 of fixed blade 81 vertically overlapping the raised protrusions 115 and 117 on face 108 as clearly shown in FIG. 3.

At this point, it should be readily apparent that it is the inclusion of the projections 114-118 which provides for the reduced gap 120 and enables finer crushed ice to be produced without altering other aspects of the overall ice crushing mechanism. As fixed blades 81 and 82 are preferably metal, protrusions 114-118 can readily be formed by a stamping operation. However, there are certainly other ways to establish protrusions 114-118, including attaching separate elements onto blades 81 and 82. In further accordance with an aspect of the invention, an underside section (not separately labeled) of divider plate 66 can also be provided with protrusions, such as indicated at 122 and 123, in order to correspondingly reduce the spacing or gap between divider plate 66 and rotatable blade 71. Divider plate 66 can be formed of plastic wherein divider plate 66 would just be integrally molded with protrusions 122 and 123, or made of metal wherein protrusions 122 and 123 could be stamped. Again, separate elements could also be attached to divider plate 66 for this purpose.

Based on the above, it should be readily apparent that the ice crushing system of the invention enables various forms of known ice crushing systems to be conveniently and readily reconfigured to produce finer crushed ice without tightening system tolerances and adding any significant costs. Although described with respect to preferred embodiments of the invention, it should be readily apparent that various changes and/or modifications can be made to the invention without departing from the spirit thereof. For instance, although the protrusions have been disclosed as being on the divider plate and fixed blades, either additional or alternative protrusions could be provided on the rotating blades, such as indicated in FIG. 3 at 127 and 128 for exemplary purposes even though symmetrical protrusions on the blade arms would be preferably employed, to alter the effective gap. In addition, although raised circular protrusions are depicted at least on the fixed blades, different shapes and configurations could be employed. Finally, although the ice crushing system of the invention has been shown and described in connection with a vertically arranged ice producing and dispensing arrangement, it should be recognized that the ice crushing system can be equally employed in horizontally disposed and other known arrangements. In any event, the invention is only intended to be limited by the scope of the following claims.

I claim:

1. A refrigerator comprising:

a cabinet having defined therein a refrigerated compartment;

an icemaker;

a dispenser for water and/or ice; and an ice crushing system interposed between the icemaker and the dispenser, said ice crushing system including a plurality of interleaved blades, at least one of said plurality of interleaved blades including raised protrusions reducing spacing with adjacent ones of said plurality of interleaved blades.

2. The refrigerator according to claim 1, wherein the plurality of interleaved blades are constituted by a plurality of rotatable blades and at least one fixed blade interposed between the plurality of rotatable blades.

3. The refrigerator according to claim 2, wherein the raised protrusions are provided on the at least one fixed blade.

4. The refrigerator according to claim 3, wherein the at least one fixed blade includes opposing face portions, with the raised protrusions projecting from each of the opposing face portions.

5. The refrigerator according to claim 4, wherein the raised protrusions on the opposing face portions of the at least one fixed blade are staggered along a length of the at least one fixed blade.

6. The refrigerator according to claim 5, wherein the raised protrusions on one of the opposing face portions overlap the raised protrusions on another one of the opposing face portions.

7. The refrigerator according to claim 1, wherein the ice crushing system further includes a divider plate arranged adjacent one of the plurality of interleaved blades, wherein the divider plate is provided with at least one protrusion extending toward the one of the plurality of interleaved blades.

8. A refrigerator comprising:

a cabinet having defined therein a refrigerated compartment;

an icemaker;

a dispenser for water and/or ice; and an ice crushing system interposed between the icemaker and the dispenser, said ice crushing system including a plurality of rotatable blades positioned on either side of a fixed member, at least one of said plurality of rotatable blades and the fixed member including raised protrusions reducing spacing between the fixed member and a respective one of said plurality of rotatable blades.

9. The refrigerator according to claim 8, wherein the raised protrusions are provided on the fixed member.

10. The refrigerator according to claim 9, wherein the fixed member includes opposing face portions, with the raised protrusions projecting from each of the opposing face portions.

11. The refrigerator according to claim 10, wherein the raised protrusions on the opposing face portions of the fixed member are staggered along a length of the fixed member.

12. The refrigerator according to claim 11, wherein the raised protrusions on one of the opposing face portions overlap the raised protrusions on another one of the opposing face portions.

13. The refrigerator according to claim 8, wherein the ice crushing system further includes a divider plate arranged adjacent one of the plurality of rotatable blades, wherein the divider plate is provided with at least one protrusion extending toward the one of the plurality of rotatable blades.

14. The refrigerator according to claim 8, wherein the fixed member is a fixed blade.

15. The refrigerator according to claim 14, further comprising at least one additional fixed blade, wherein the plurality of rotatable blades are interleaved with the fixed blade and the at least one additional fixed blade.

16. A method of producing finely crushed ice comprising: directing ice cubes between a plurality of rotatable blades and at least one fixed member of an ice crushing system wherein at least one of said plurality of rotatable blades and the fixed member includes raised protrusions reducing spacing between the fixed member and a respective one of said plurality of rotatable blades to produce finely crushed ice.

17. The method of claim 16, further comprising: operating an auger to both direct the ice cubes between the plurality of rotatable blades and rotate the plurality of rotatable blades relative to the fixed member.

18. The method of claim 16, wherein the raised protrusions are on the fixed member such that the plurality of rotatable blades are rotated relative to the raised protrusions.

19. The method of claim 18, wherein the raised protrusions are provided on opposing sides of the fixed member for producing the finely crushed ice.

20. The method of claim 17, further comprising: directing some of the ice cubes between a divider plate, which is arranged adjacent one of the plurality of rotatable blades and provided with at least one protrusion extending toward the one of the plurality of rotatable blades, in producing the finely crushed ice.

* * * * *